US010688327B2

(12) United States Patent
Johnson et al.

(10) Patent No.: US 10,688,327 B2
(45) Date of Patent: Jun. 23, 2020

(54) OVEN APPLIANCE AND A FLAME ARRESTER FOR AN OVEN APPLIANCE

(71) Applicant: Haier US Appliance Solutions, Inc., Wilmington, DE (US)

(72) Inventors: Eric Scott Johnson, Louisville, KY (US); Charles David Christensen Phillips, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 341 days.

(21) Appl. No.: 15/841,492

(22) Filed: Dec. 14, 2017

(65) Prior Publication Data

US 2019/0184216 A1 Jun. 20, 2019

(51) Int. Cl.

| | |
|---|---|
| ***A62C 3/00*** | (2006.01) |
| ***A62C 4/00*** | (2006.01) |
| ***F24C 3/12*** | (2006.01) |
| ***F24C 15/02*** | (2006.01) |
| ***F24C 15/00*** | (2006.01) |

(52) U.S. Cl.

CPC ..... *A62C 3/006* (2013.01); *A62C 4/00* (2013.01); *F24C 3/128* (2013.01); *F24C 15/006* (2013.01); *F24C 15/021* (2013.01)

(58) Field of Classification Search

CPC . A62C 3/006; A62C 4/00; F24C 3/128; F24C 15/021; F24C 15/006

See application file for complete search history.

(56) References Cited

U.S. PATENT DOCUMENTS 3,739,146 A 6/1973 Gilliom
9,643,037 B2 5/2017 Vermeersch et al.

*Primary Examiner* — David J Laux

(74) *Attorney, Agent, or Firm* — Dority & Manning, P.A.

(57) ABSTRACT

An oven appliance and flame arrester therefore are provided herein. The flame arrester may include a first member and a second member. The first member may extend in a lateral direction along a portion of the opening. The first member may define a chamber aperture extending along an arrest axis in fluid communication with the cooking chamber. The second member may extend from the first member and away from the cooking chamber. The second member may define an intake aperture extending non-parallel to the arrest axis. A fluid passage may be defined between the first member and the second member in fluid communication between the intake aperture and the chamber aperture.

18 Claims, 8 Drawing Sheets

OVEN APPLIANCE AND A FLAME ARRESTER FOR AN OVEN APPLIANCE

FIELD OF THE INVENTION

The present subject matter relates generally to oven appliances and flame arresters for the same.

BACKGROUND OF THE INVENTION

Oven appliances generally define one or more enclosures supporting one or more heating elements. For instance, oven appliances can include a cabinet defining an insulated cooking chamber therein for receipt of food items for cooking. Generally, one or more doors are provided on the cabinet to selectively permit and restrict access to the cooking chamber.

A door of the oven appliance may form a seal against the cabinet to assist with insulating the cooking chamber or with containing cooking fumes within the cooking chamber. Nonetheless, it may be desirable to permit a certain amount of air to enter the cavity in order to facilitate proper combustion. It may also be desirable to have one or more outlets for moisture to escape the cavity. However, if food items or residue ignite during a cooking or cleaning cycle of the oven appliance, the pressure of the fluid within the cooking chamber may increase. In certain appliances or conditions, it is possible that pressure increase may force the door to open, allowing heat, gases, and fumes generated in the cooking chamber to escape. In other appliances, it is also possible that an undesirable amount of heat or flames may escape through any openings to the cooking chamber, such as openings that may otherwise permit air or moisture to/from cooking chamber.

Accordingly, an oven appliance with features for dissipating pressure increases in the cooking chamber would be beneficial. In particular, a flame arrester that dissipates pressure increases in the cooking chamber of an oven appliance would be useful. Additionally, a flame arrester with features for halting or quenching flames from the cooking chamber of an oven appliance would be advantageous.

BRIEF DESCRIPTION OF THE INVENTION

Aspects and advantages of the invention will be set forth in part in the following description, or may be obvious from the description, or may be learned through practice of the invention.

In one aspect of the present disclosure, an oven appliance is provided. The oven appliance may include a cabinet, a door, and a flame arrester. The cabinet may define a cooking chamber for receipt of food items therein. The cabinet may further define an opening at a front portion of the cabinet. The door may be mounted to the cabinet. The door may be selectively adjustable between an open position and a closed position. The open position may permit access to the cooking chamber through the opening of the cabinet; the closed position may restrict access to the cooking chamber through the opening of the cabinet. The flame arrester may include a first member and a second member. The first member may extend in a lateral direction along a portion of the opening. The first member may define a chamber aperture extending along an arrest axis in fluid communication with the cooking chamber. The second member may extend from the first member and away from the cooking chamber. The second member may define an intake aperture extending non-parallel to the arrest axis. A fluid passage may be defined between the first member and the second member in fluid communication between the intake aperture and the chamber aperture.

In one aspect of the present disclosure, a flame arrester for an oven appliance is provided. The flame may include a first member, a second member, a third member, and a fourth member. The first member may extend in a lateral direction between a first lateral end and a second lateral end. The first member may define a chamber aperture extending along an arrest axis in fluid communication with the oven appliance. The second member may extend from the first member and define an intake aperture extending non-parallel to the arrest axis. The third member may extend vertically from the first member at the first lateral end. The fourth member may extend vertically from the first member at the second lateral end. A fluid passage may be defined between the first member and the second member in fluid communication between the intake aperture and the chamber aperture.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
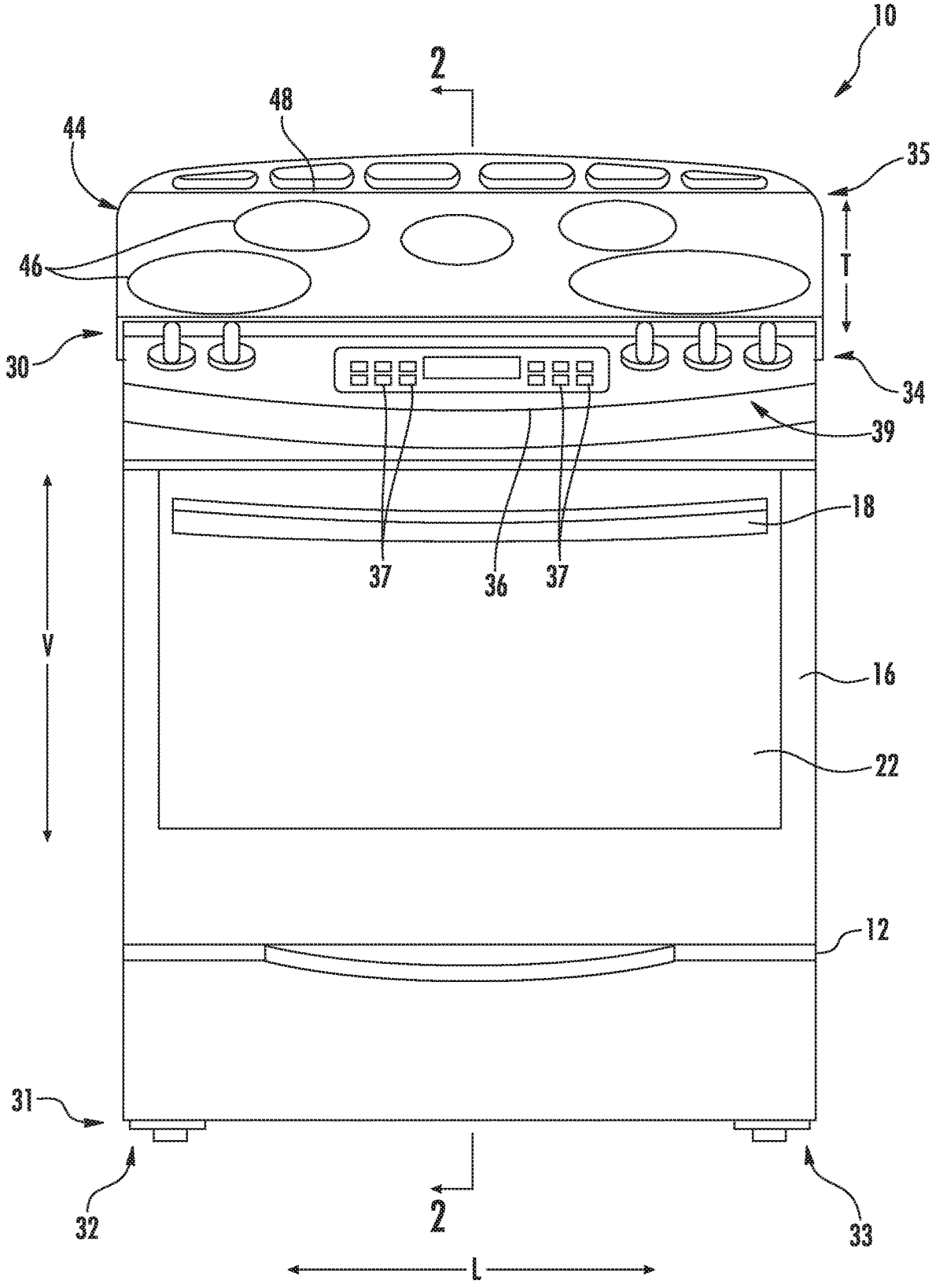
FIG. 1 provides a front perspective view of an oven appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present disclosure. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Figure 2:
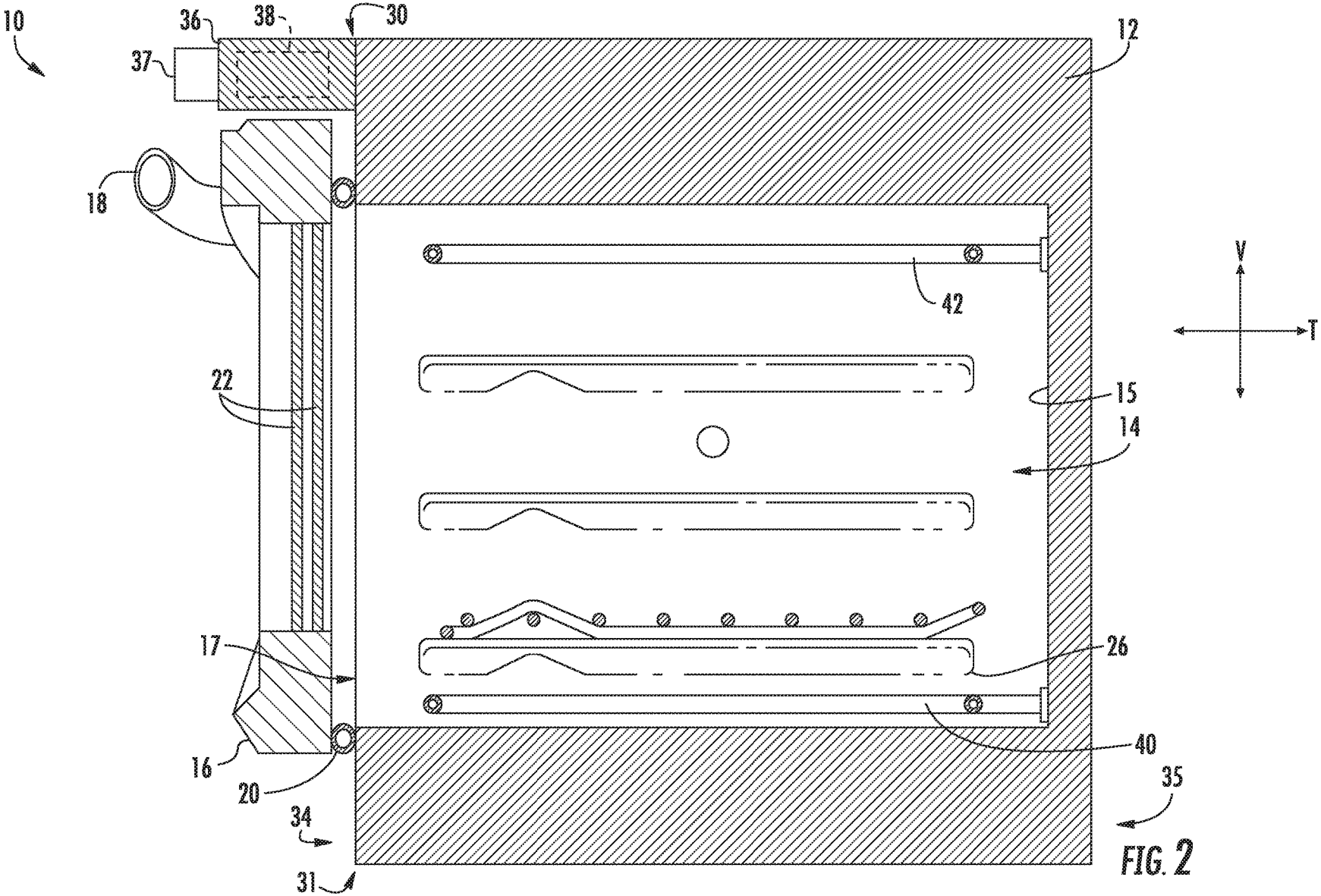
FIG. 2 provides a cross sectional view of the exemplary oven appliance of FIG. 1, taken along the line 2-2.

Turning now to the figures, FIG. 1 provides a front perspective view of an oven appliance 10 according to an example embodiment of the present disclosure. FIG. 2 provides a side, cross section view of oven appliance 10 taken along the 2-2 line of FIG. 1 (e.g., taken in a plane that is perpendicular to a lateral direction L). It should be understood that oven appliance 10 is provided by way of example only and is not intended to limit the present disclosure in any aspect. Thus, the present disclosure may be used with other oven appliance configurations (e.g., configurations that define multiple interior cavities for the receipt of food or have different pan or rack arrangements than what is shown in FIG. 2). Further, the present disclosure may be used in any other suitable cooking appliance, such as a wall oven appliance, counter-mounted range appliance, etc.

As may be seen in FIGS. 1 and 2, oven appliance 10 defines a vertical direction V, a lateral direction L, and a transverse direction T. The vertical direction V, lateral direction L, and transverse direction T are each mutually perpendicular and together form an orthogonal direction system. Oven appliance 10 includes an insulated cabinet 12. Cabinet 12 extends between a top portion 30 and a bottom portion 31 (e.g., along the vertical direction V). Cabinet 12 also extends between a first side portion 32 and a second side portion 33 (e.g., along the lateral direction L). Cabinet 12 further extends between a front portion 34 and a back portion 35 (e.g., along the transverse direction T). An internal wall 15 is generally positioned within cabinet 12 and defines an insulated cooking chamber 14.

As may be seen in FIG. 2, a door 16 is mounted on the cabinet 12. For instance, door 16 may be pivotally mounted on the cabinet 12 to selectively restrict access to the cooking chamber 14 through an opening 17 (e.g., when door 16 is in a closed setting, as shown in FIG. 2). Thus, the door 16 is selectively adjustable between an open position and a closed position, the open position permitting access to the cooking chamber 14 through the opening 17 of the cabinet 12, and the closed position restricting access to the cooking chamber 14 through the opening 17 of the cabinet 12. A handle 18 is mounted to door 16 and may generally assist a user with opening and closing door 16 for accessing cooking chamber 14.

A seal or gasket 20 extends (e.g., in the transverse direction T) between door 16 and cabinet 12, such as when door 16 is in the closed position. Gasket 20 may assist with maintaining heat and cooking fumes within cooking chamber 14 when door 16 is in the closed position, as shown in FIG. 2.

Figure 3:
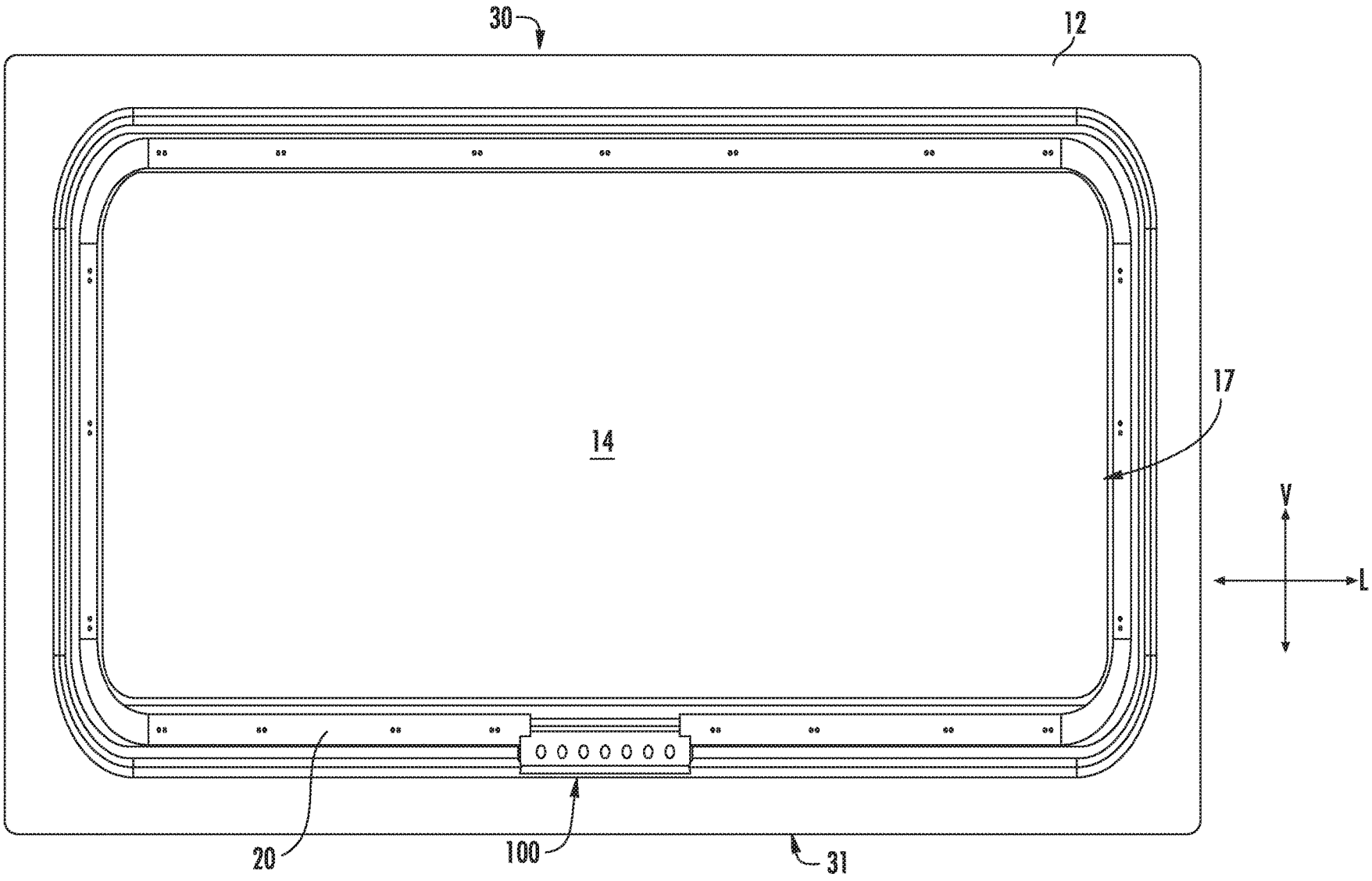
FIG. 3 provides a front view of a portion of the cabinet of an oven appliance including a flame arrester according to exemplary embodiments of the present disclosure.

Turning briefly to FIG. 3, a front view of a portion of the cabinet 12 of oven appliance 10 is illustrated. In particular, cabinet 12 is shown at the opening 17 to cooking chamber 14. The door 16 (FIG. 2) is removed for the sake of clarity. As shown, gasket 20 is mounted about the opening 17. Thus, when door 16 is in the closed position, the seal between door 16 and gasket 20 may generally surround the opening 17. However, as will be described in further detail below, a flame arrester 100 may interrupt a portion of gasket 20 about the perimeter of the opening 17. In turn, door 16 may be prevented from forming a complete seal (e.g., a seal which prevents the passage of any fluid to/from opening 17) at flame arrester 100 when in the closed position.

Returning to FIG. 2, multiple (e.g., two) parallel glass panes 22 provide for viewing the contents of cooking chamber 14 when door 16 is in the closed position and may also assist with insulating cooking chamber 14. A baking rack may be positioned in cooking chamber 14 for the receipt of food items or utensils containing food items. The baking rack may be slidably received onto embossed ribs or sliding rails 26 defined on internal wall 15 such that the baking rack may be conveniently moved into and out of cooking chamber 14 when door 16 is open.

In some embodiments, a bake or bottom heating element 40 is positioned in cabinet 12 (e.g., at or adjacent bottom portion 31 of cabinet 12). Bottom heating element 40 may be used to heat cooking chamber 14 for both cooking and cleaning of oven appliance 10. The size and heat output of bottom heating element 40 can be selected based on, for example, the size of oven appliance 10. Bottom heating element 40 can be any suitable heating element. For example, bottom heating element 40 may be an electric resistance heating element, a gas burner, a microwave heating element, etc.

In additional or alternative embodiments, a broil or top heating element 42 is also positioned in cooking chamber 14 of cabinet 12 (e.g., at or adjacent top portion 30 of cabinet 12). Top heating element 42 may be used to heat cooking chamber 14 for both cooking/broiling and cleaning of oven appliance 10. Like bottom heating element 40, the size and heat output of top heating element 42 can be selected based on, for example, the size of oven appliance 10. Moreover, top heating element 42 can be any suitable heating element. For example, top heating element 42 may be an electric resistance heating element, a gas burner, a microwave heating element, etc.

In optional embodiments, a cooktop 44 is positioned at top portion 30 of oven appliance 10. As shown, cooktop 44 includes a top panel 48 that is mounted to cabinet 12 (e.g., at the top portion 30). Top panel 48 may be a generally planar member having an upper surface that is perpendicular to the vertical direction V. Top panel 48 may be formed from glass, glass ceramic, metal, or another suitable material. Cooktop 44 further includes a plurality of heating assemblies 46 positioned mounted to top panel 48. In some embodiments, heating assemblies 46 are positioned above cooking chamber 14 of cabinet 12 (i.e., higher relative to the vertical direction V). Cooking utensils, such as pots, pans, griddles, etc., may be placed on top panel 48 and heated with heating assemblies 46 during operation of oven appliance 10. It is understood that heating assemblies 46 may be any suitable heating assembly, such as gas burner elements, radiant heating elements, resistive heating elements, induction heating elements, etc.

As shown, oven appliance 10 is further equipped with a controller 38 to regulate operation of the oven appliance 10. For example, controller 38 may regulate the operation of oven appliance 10 including heating elements 40, 42, or 46. Controller 38 may be in communication (via for example a suitable wired or wireless connection) with the heating elements 40, 42, or 46 and other suitable components of the oven appliance 10, as discussed herein. In general, controller 38 may be operable to configure the oven appliance 10 (and various components thereof) for cooking. Such configuration may be based on a plurality of cooking factors of a selected operating cycles, sensor feedback, etc.

By way of example, controller 38 may include one or more memory devices (e.g., non-transitive media) and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 38 may be positioned in a variety of locations throughout oven appliance 10. In the illustrated embodiment, controller 38 is mounted to control panel 36. Specifically, controller 38 is located beneath a user interface 39 of oven appliance 10, as shown in FIG. 2. In some such embodiments, input/output ("I/O") signals may be routed between the controller 38 and various operational components of oven appliance 10 (e.g., along wiring harnesses that is routed through cabinet 12). Typically, controller 38 is in communication with user interface 39 and inputs 37 through which a user may select various operational features and modes, and may monitor progress of oven appliance 10. In some embodiments, user interface 39 represents a general purpose I/O ("GPIO") device or functional block. In additional or alternative embodiments, user interface 39 includes input components or inputs 37, such as one or more of a variety of electrical, mechanical or electro-mechanical input devices including rotary dials, push buttons, and touch pads. User interface further 39 may include a display component, such as a digital or analog display device designed to provide operational feedback to a user.

When assembled, user interface 39 may be in communication with controller 38 via one or more signal lines or shared communication busses. Controller 38 may also be communication with one or more sensors, such as a temperature sensor that is used to measure temperature inside insulated cooking chamber 14 and provide such measurements to controller 38. For example, the temperature sensor may be a thermocouple, a thermistor, a resistance temperature detector, or any other device suitable for measuring a temperature on appliance 10 (e.g., within cooking chamber 14 or at top panel 48). In this manner, controller 38 may selectively control heating elements 40, 42, or 46 in response to user manipulation of user interface 39 and temperature feedback from a temperature sensor. Controller 38 can also receive temperature measurements from the temperature sensor and, for example, provide a temperature indication to the user with a display device of user interface 39.

Figure 7:
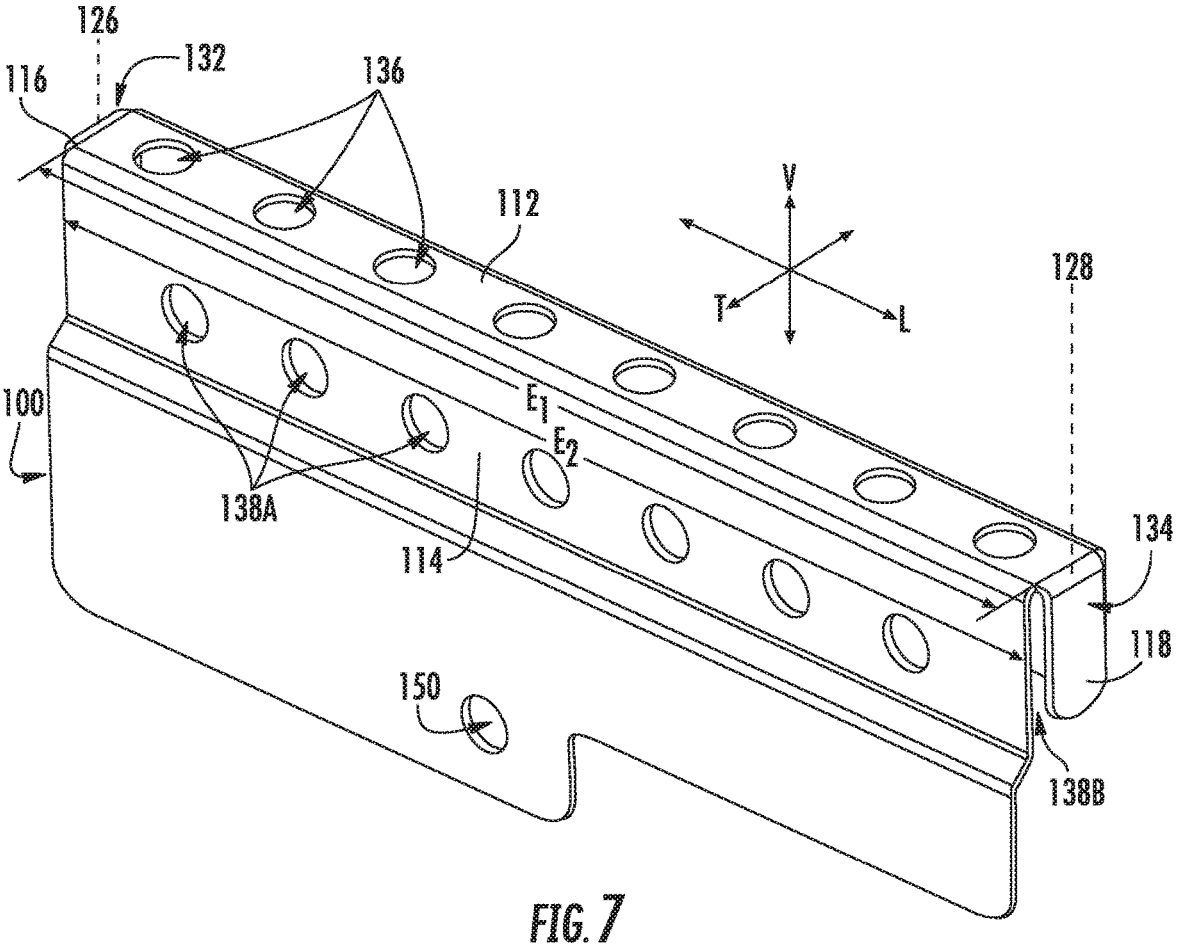
FIG. 7 provides a front perspective view of a flame arrester according to exemplary embodiments of the present disclosure.
Figure 8:
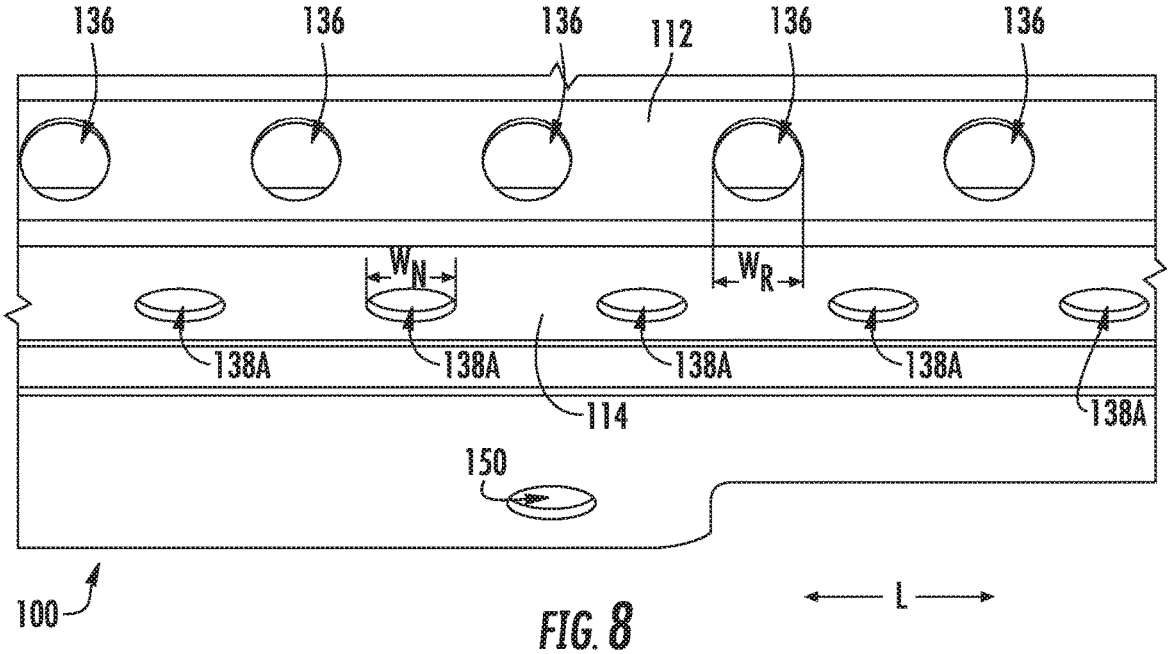
FIG. 8 provides a magnified, top, perspective view of the exemplary flame arrester of FIG. 7.
Figure 9:
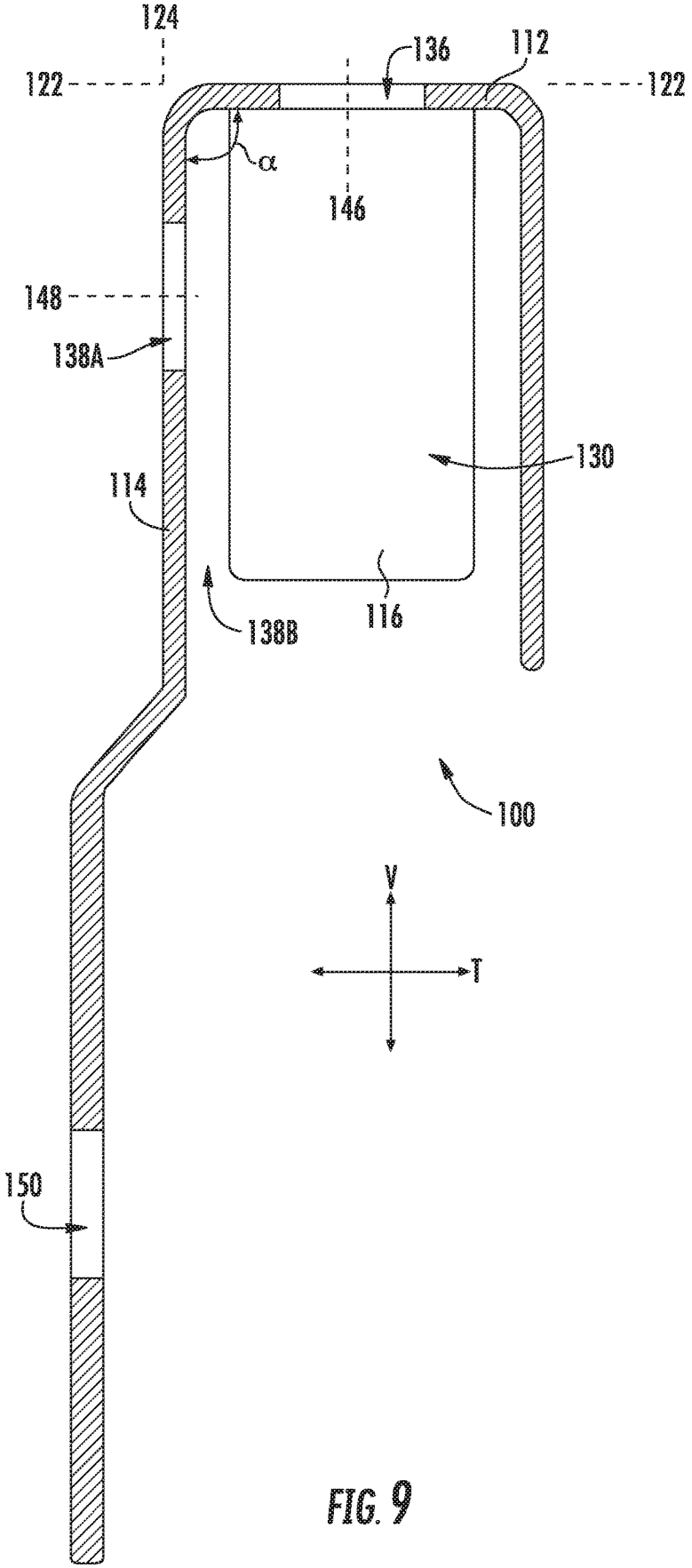
FIG. 9 provides a cross sectional view of the exemplary flame arrester of FIG. 7.

Turning now to FIGS. 3 through 9, various views of a flame arrester 100 according to exemplary embodiments of the present disclosure are provided. In particular, FIGS. 3 through 6 illustrate flame arrester 100 mounted to cabinet 12 according to exemplary embodiments. FIGS. 7 through 9 illustrate a flame arrester 100 in isolation (i.e., apart from cabinet 12).

As illustrated, flame arrester 100 includes a plurality of unique members (e.g., first member 112, second member 114, third member 116, fourth member 118, etc.) positioned in discrete planes with respect to each other. When assembled, a first member 112 may be positioned adjacent to (e.g., in contact with) a second member 114. Moreover, a non-parallel angle $\alpha$ (e.g., between 0° and 180°) is defined between first member 112 and second member 114. In other words, first member 112 and second member 114 may lie in separate planes (e.g., a first plane 122 and a second plane 124, respectively). Non-parallel angle $\alpha$ may be defined between the separate planes 122 and 124. For example, non-parallel angle $\alpha$ may be between 80° and 120°. Additionally or alternatively, non-parallel angle $\alpha$ may be between 105° and 85°. Furthermore, non-parallel angle $\alpha$ may be 90° such that second member 114 is positioned perpendicular to first member 112.

Together, first member 112 and second member 114 define a fluid passage 130 therebetween. As shown, the fluid passage 130 extends along the lateral direction L (e.g., along a lateral length $E_1$ or $E_2$ of first member 112 or second member 114). When assembled (e.g., in mutual contact), first member 112 may bound fluid passage 130 along the vertical direction V (e.g., to define an upper limit of fluid passage 130), while second member 114 bounds fluid passage 130 along the transverse direction T (e.g., to define a forward limit of fluid passage 130). In some such embodiments, first member 112 and second member 114 each have a lateral length $E_1$ and $E_2$, respectively, that is equal to the other. Thus, fluid passage 130 may have a lateral length equal to that of the first and second members 112, 114 (i.e., equal to $E_1$ and $E_2$).

In some embodiments, a third member 116 and a fourth member 118 are provided at opposite lateral ends 130, 132 of flame arrester 100. For instance, third member 116 may extend vertically (e.g., toward fluid passage 130) from first member 112 at one lateral end of first member 112 (e.g., lateral end 130); fourth member 118 may extend vertically (e.g., toward fluid passage 130) from first member 112 at another end (e.g., lateral end 132). Optionally, third and fourth members 116, 118 may be parallel to each other on opposite sides of the length $E_1$ of first member 112. In other words, third and fourth members 116, 118, may lie in parallel planes 126, 128 spaced apart from each other (e.g., along the lateral direction L). Optionally, the planes 126 and 128 may be perpendicular to one or both of the planes 122 and 124. In certain embodiments, third and fourth member 118 bound fluid passage 130 along the lateral direction L (e.g., to at least partially enclose and define opposite left and right limits of fluid passage 130). Thus, in the exemplary embodiment shown, first, second, third, and fourth members 112, 114, 116, 118 form a generally U-shaped channel within fluid passage 130. Other numbers and configurations of the members of flame arrester 100 may be used as well.

In some embodiments, first member 112 defines (e.g., at least partially defines) one or more chamber apertures 136 in fluid communication with fluid passage 130. For instance, each chamber aperture 136 may extend along an arrest axis 146 through first member 112. If a plurality of chamber apertures 136 is defined through first member 112, each chamber aperture 136 may extend along a discrete arrest axis 146. In some such embodiments, each arrest axis 146 is parallel to the other arrest axis/axes 146. Other embodiments may provide multiple arrest axes at non-parallel angles relative to each other. Optionally, at least one arrest axis 146 may be perpendicular to first member 112 (e.g., perpendicular to first plane 122). Additionally or alternatively, arrest axis 146 may be parallel to the vertical direction V.

Generally, chamber apertures 136 may have any suitable profile or shape. For instance, as shown in the exemplary embodiments of FIGS. 3 through 9, chamber apertures 136 may be circular in shape (e.g., defined at a set diameter or width $W_R$). However, alternative embodiments may have a shape that is elongated, elliptical, rectangular, etc. In optional embodiments, the maximum (e.g., width $W_R$) of chamber apertures 136 is less an inch. For instance, the width $W_R$ may be between 0.05 inch and 0.5 inch. Additionally or alternatively, the width $W_R$ may be between 0.1 inch and 0.25 inch (e.g., 0.125 inch). Thus, flames within cooking chamber 14 may be prevented from propagating through flame arrester 100. If a plurality of chamber apertures 136 is defined through first member 112, each chamber aperture 136 may have an identical or unique shape.

In certain embodiments, second member 114 defines (e.g., at least partially defines) one or more intake apertures (e.g., intake apertures 138A, 138B) in fluid communication with fluid passage 130. In particular, fluid passage 130 may be defined in fluid communication between the intake aperture 138A, 138B and the chamber aperture 136.

As shown, at least one or more intake apertures 138A may extend along an entry axis 148 through second member 114. If a plurality of intake apertures 138A is defined through second member 114, each intake aperture 138A may extend along a discrete intake axes that is non-parallel to arrest axis 146. In some such embodiments, each entry axis 148 is parallel to the other entry axis/axes 148. Other embodiments may provide multiple intake axes at non-parallel angles relative to each other. Optionally, at least one entry axis 148 may be perpendicular to second member 114 (e.g., perpendicular to first plane 122). Additionally or alternatively, entry axis 148 may be parallel to the transverse direction T.

In optional embodiments, one or more intake apertures 138B are defined at the lateral ends 130, 132 of flame arrester 100. For instance, one intake aperture 138B may be defined by and between the second member 114 and the third member 116. Another discrete intake aperture 138B may be defined by and between the second member 114 and the fourth member 118.

Generally, intake apertures 138A, 138B may have any suitable profile or shape. For instance, as shown in the exemplary embodiments of FIGS. 3 through 9, intake apertures 138A defined entirely by second member 114 may be circular in shape (e.g., defined at a set diameter or width $W_N$). However, alternative embodiments may have a shape that is elongated, elliptical, rectangular, etc. In optional embodiments, the width $W_N$ of intake apertures 138A is equal to the width $W_R$ of chamber apertures 136. However, alternative embodiments may define a unique width for intake apertures 138A that is different from chamber apertures 136. Moreover, in additional or alternative embodiments, intake apertures 138B defined between second member 114 and third or fourth member 116, 118 may be defined a slot (e.g., linear slot) having a vertical length greater than a horizontal width. If a plurality of intake apertures 138A, 138B is defined through second member 114, some of the intake apertures (e.g., a plurality of the intake apertures 138A) may have an identical or unique shape.

Turning to FIG. 8 in particular, optional embodiments may provide a plurality of chamber apertures 136 and plurality of intake apertures 138A offset from each other. For instance, the apertures 136 and 138A may be offset along the lateral direction L. In other words, the plurality of intake apertures 138A arranged in an alternating offset pattern along the lateral direction relative to the plurality of chamber apertures 136. Notably, a fluid path defined between intake aperture 138A and chamber aperture 136 (e.g., through fluid passage 130) may be elongated, restricting fluid flow through flame arrester 100.

In addition to chamber apertures 136 and intake apertures 138A, 138B, flame arrester 100 may define at least one attachment aperture 150. For example, a bracket portion extending (e.g., vertically) from second member 114 of the flame arrester 100 may define an attachment aperture 150 for attaching the flame arrester 100 to the oven appliance 10 (e.g., on an exterior surface 63 of cabinet 12). Flame arrester 100 may be connected, fixed, or coupled to oven appliance 10 using any appropriate fastener (e.g., screws or the like), or using any other suitable mechanism. Although shown as being mounted to cabinet 12 at exterior surface 63, alternative embodiments may be fixed to other suitable portions of oven appliance 10, such as an interior surface 65 of the cooking chamber 14 or an inner surface 67 of the door 16.

Figure 10:
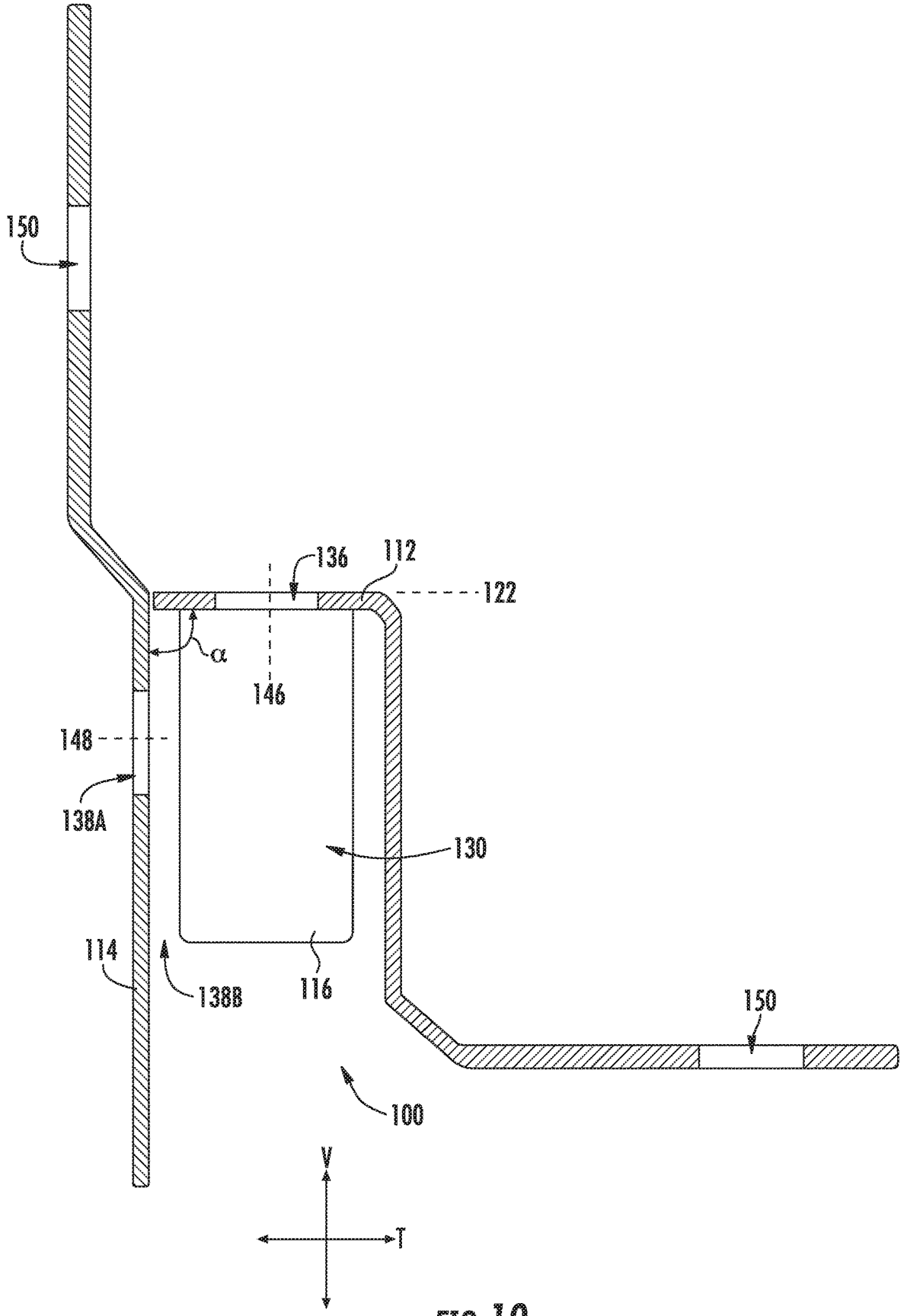
FIG. 10 provides a cross sectional view of a flame arrester according to alternative exemplary embodiments of the present disclosure.

As shown in the exemplary embodiments of FIGS. 3 through 9, flame arrester 100 may be integrally formed. For instance, first member 112 and second member 114 may be integrally attached as a monolithic unit. Alternatively, as illustrated in FIG. 10, first and second members 112, 114 may be selectively separable. As an example, second member 114 may be fixed to an inner surface 67 of door 16 (FIG. 3) while first member 112 is fixed to cabinet 12 (e.g., at interior surface 65—FIG. 3). In turn, opening the door 16 may force second member 114 to separate from first member 112, while closing the door 16 may bring second member 114 to substantially the same position as illustrated in FIGS. 3 through 6 (e.g., adjacent to first member 112 and in contact with exterior surface 63).

Turning especially to FIGS. 3 through 6, when mounted on the cabinet 12, first member 112 extends in the lateral direction L along at least a portion of the opening 17. Second member 114 may be positioned forward from first member 112 relative to the transverse direction T. In other words, second member 114 may be adjacent to a forward or front portion of first member 112 (e.g., distal to the cooking chamber 14). Moreover, second member 114 may extend from first member 112 at the non-parallel angle $\alpha$. For instance, second member 114 may extend away from cooking chamber 14 and opening 17 along the vertical direction V.

In certain embodiments, flame arrester 100 is positioned at a bottom portion of cabinet 12. For instance, flame arrester 100 may be mounted to cabinet 12 below opening 17. Notably, relatively cool ambient air may be drawn into cooking chamber 14 (as indicated at arrow 102). Optionally, flame arrester 100 may be centered along the lateral direction relative to opening 17 (e.g., at a lateral midpoint of the opening 17). However, alternative embodiments may provide flame arrester 100 at another suitable location (e.g., above opening 17).

When assembled, flame arrester 100 may be placed along the perimeter path of gasket 20. For instance, gasket 20 may extend to and from opposite lateral ends 130, 132 of flame arrester 100, as illustrated between FIGS. 5 and 6 especially. Although the gasket 20 is removed for clarity at FIG. 5, FIG. 6 demonstrates that the gasket 20 may laterally bound flame arrester 100. For instance, gasket 20 may abut third member 116 and fourth member 118. When door 16 is in the closed position, flame arrester 100 may thus partially break the seal between gasket 20 and door 16 (e.g., at the bottom portion of cabinet 12 wherein flame arrester 100 is mounted).

Figure 4:
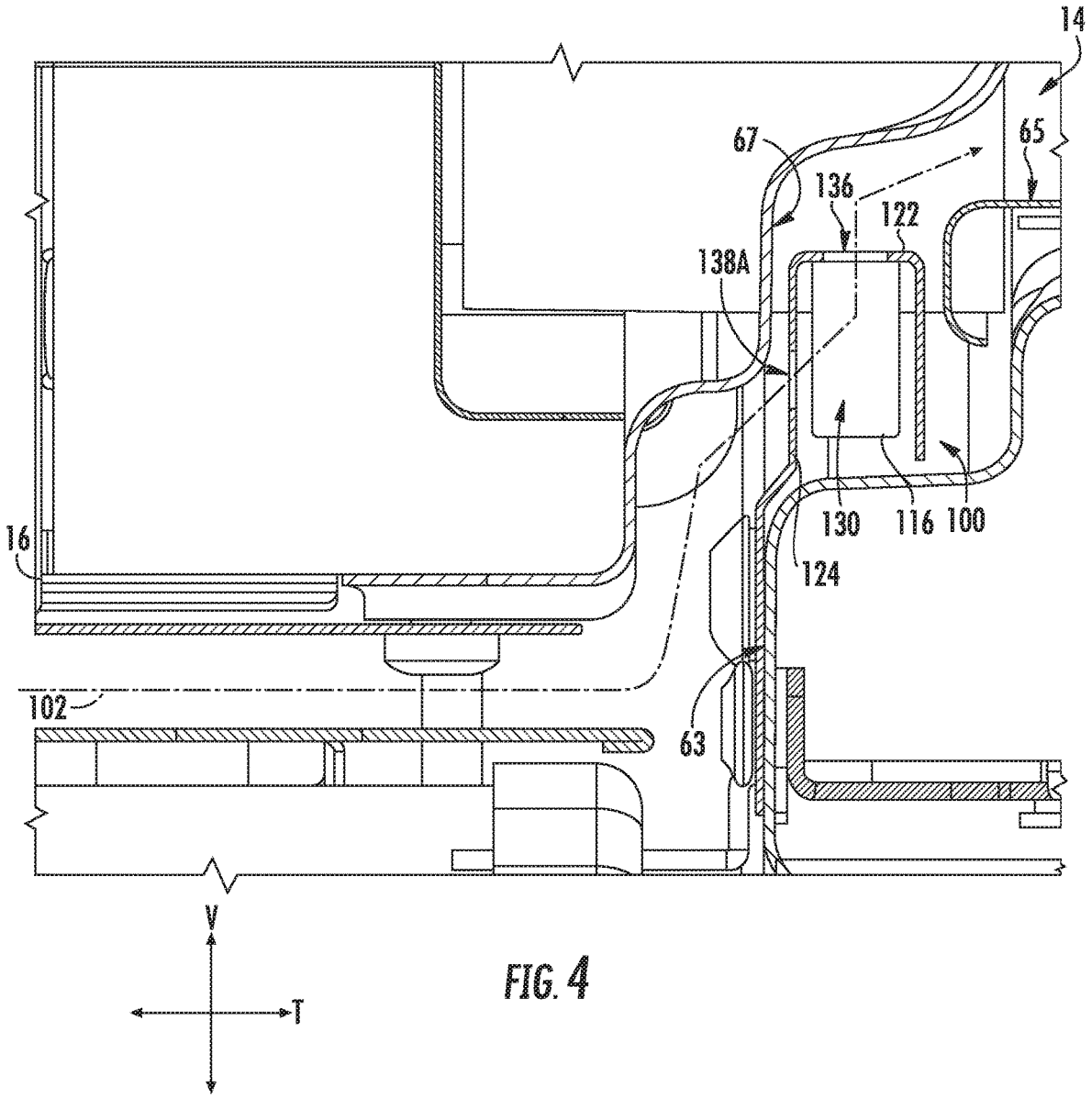
FIG. 4 provides a magnified cross sectional view of a bottom portion of an oven appliance including a flame arrester according to exemplary embodiments of the present disclosure.
Figure 5:
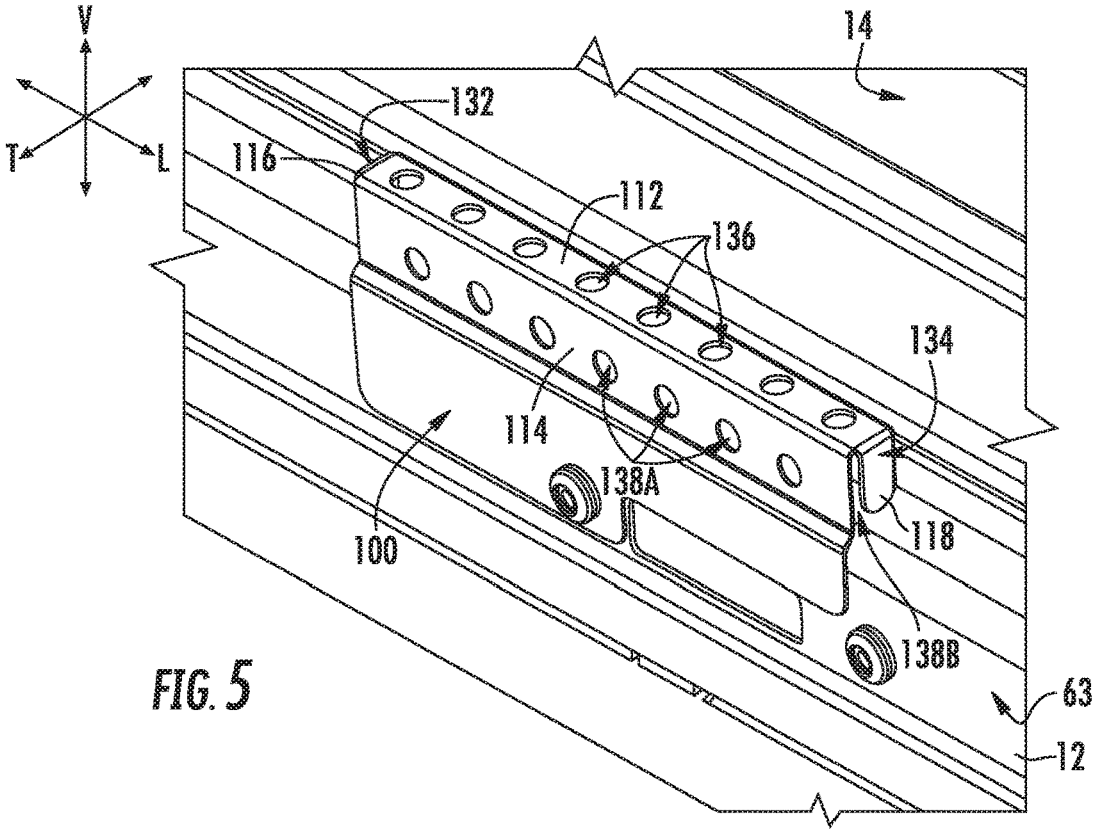
FIG. 5 provides a magnified perspective view of a flame arrester attached to the cabinet of an oven appliance according to exemplary embodiments of the present disclosure.
Figure 6:
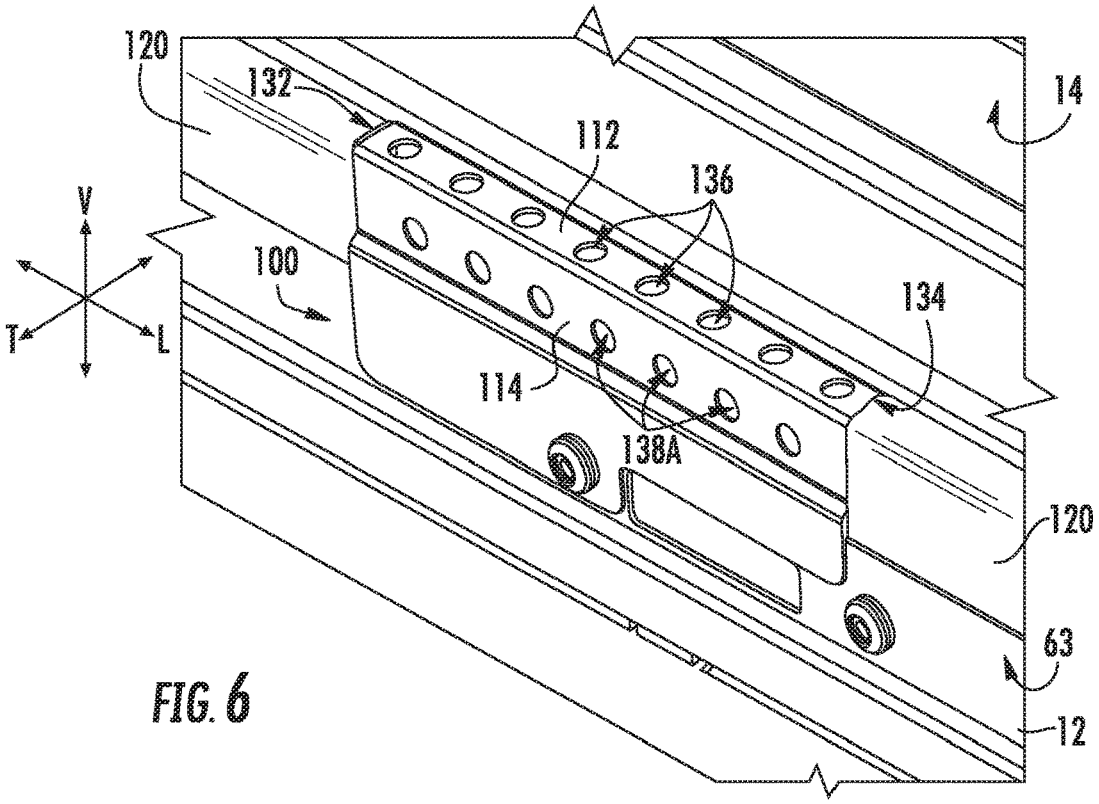
FIG. 6 provides a magnified perspective view of a flame arrester and gasket attached to the cabinet of an oven appliance according to exemplary embodiments of the present disclosure.

As shown, in particular at FIG. 4, fluid passage 130 forms an air gap between door 16 and cabinet 12 (e.g., at the bottom portion 31 of cabinet 12—FIG. 1). Fluid passage 130 may thus permits a flow of fluid (e.g., air, moisture, or combustion fluids) between an interior and an exterior of oven appliance 10 through intake and chamber apertures 138A, 138B and 136. In particular, fluid passage 130 permits a flow of fluid between cooking chamber 14 and an environment external to cooking chamber 14 such that fluid may flow from cooking chamber 14 to the external environment and from the external environment to cooking chamber 14. In the event of ignition of food items or residue within cooking chamber 14, the temperature of the fluid within cooking chamber 14 increases and, thus, the pressure of the fluid increases because the volume of the fluid is fixed by the volume of cooking chamber 14. Flame arrester 100 advantageously allows the pressure of the fluid within cooking chamber 14 to dissipate (e.g., such that door 16 is not pushed open by the force of the expanding fluid within cooking chamber 14). Further, any flames from the ignition event may be advantageously prevented from escaping cooking chamber 14.

It is noted that although fluid passage 130 is shown as a generally open cavity in fluid communication between first member 112 and second member 114, additional or alternative embodiments may include one or more flame-quenching materials. For instance, wire gauze or ceramic honeycomb material may be packed within fluid passage 130 to increase the surface area of flame arrester 100 and the path of fluid through fluid passage 130. The smaller volumes formed as the fluid passes through flame arrester 100 have a greater surface area-to-volume ratio than one larger volume; thus, heat loss from the fluid exiting cooking chamber 14 can be increased. Also, heat from the fluid may be transferred to flame arrester 100. In this way, any flame passed from cooking chamber 14 through fluid passage 130 can be further quenched, and the increased pressure of the fluid within cooking chamber 14 can be dissipated.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A flame arrester for an oven appliance, the flame arrester comprising:

a first member extending in a lateral direction between a first lateral end and a second lateral end, the first member defining at least one chamber aperture extending along an arrest axis in fluid communication with the oven appliance;

a second member extending from the first member, the second member defining at least one intake aperture extending non-parallel to the arrest axis;

a third member extending vertically from the first member at the first lateral end; and a fourth member extending vertically from the first member at the second lateral end, wherein a fluid passage is defined between the first member and the second member in fluid communication between at least one intake aperture and at least one chamber aperture.

2. The flame arrester of claim 1, wherein the first member has a lateral length, and wherein the second member has a lateral length equal to the lateral length of the first member.

3. The flame arrester of claim 1, wherein the at least one intake aperture comprises a plurality of intake apertures, wherein one aperture of the plurality of intake apertures is defined between the second member and the third member, and wherein another aperture of the plurality of intake apertures is defined between the second member and the fourth member.

4. The flame arrester of claim 1, wherein the second member is positioned at a non-parallel angle relative to the first member.

5. The flame arrester of claim 4, wherein the non-parallel angle is 9 between 80° and 120°.

6. The flame arrester of claim 1, wherein the first member and the second member are integrally attached as a monolithic unit.

7. The flame arrester of claim 1, wherein the first member is selectively separable from the second member.

8. The flame arrester of claim 1, wherein the at least one chamber aperture of the first member comprises a plurality of chamber apertures, and wherein the at least one intake aperture of the second member comprises a plurality of intake apertures arranged in an alternating offset pattern along the lateral direction relative to the plurality of chamber apertures.

9. An oven appliance, comprising:

a cabinet defining a cooking chamber for receipt of food items therein, the cabinet further defining an opening at a front portion of the cabinet;

a door mounted to the cabinet, the door being selectively adjustable between an open position and a closed position, the open position permitting access to the cooking chamber through the opening of the cabinet, the closed position restricting access to the cooking chamber through the opening of the cabinet; and a flame arrester comprising a first member extending in a lateral direction along a portion of the opening, the first member defining at least one chamber aperture extending along an arrest axis in fluid communication with the cooking chamber, a second member extending from the first member and away from the cooking chamber, the second member defining at least one intake aperture extending non-parallel to the arrest axis, a third member extending vertically from the first member at one lateral end, and a fourth member extending vertically from the first member at another later end, wherein a fluid passage is defined between the first member and the second member in fluid communication between the intake aperture and the chamber aperture.

10. The oven appliance of claim 9, wherein the first member has a lateral length, and wherein the second member has a lateral length equal to the lateral length of the first member.

11. The oven appliance of claim 9, wherein the at least one intake aperture comprises a plurality of intake apertures, wherein one aperture of the plurality of intake apertures is defined between the second member and the third member, and wherein another aperture of the plurality of intake apertures is defined between the second member and the fourth member.

12. The oven appliance of claim 9, wherein the second member is positioned at a non-parallel angle relative to the first member.

13. The oven appliance of claim 12, wherein the non-parallel angle is between 80° and 120°.

14. The oven appliance of claim 9, wherein the first member and the second member are integrally attached as a monolithic unit.

15. The oven appliance of claim 9, wherein the first member is selectively separable from the second member.

16. The oven appliance of claim 9, wherein the at least one chamber aperture of the first member comprises a plurality of chamber apertures, and wherein the at least one intake aperture of the second member comprises a plurality of intake apertures arranged in an alternating offset pattern along the lateral direction relative to the plurality of chamber apertures.

17. The oven appliance of claim 9, further comprising a gasket mounted about the opening.

18. The oven appliance of claim 9, wherein the flame arrester extends in the lateral direction between opposite lateral ends, and wherein the gasket bounds the flame arrester at the opposite lateral ends.

* * * * *